US008827849B2

(12) United States Patent
Spiegel

(10) Patent No.: US 8,827,849 B2
(45) Date of Patent: Sep. 9, 2014

(54) LACROSSE STICK WITH IMPROVED BALL SCOOPING

(76) Inventor: H. Jay Spiegel, Mount Vernon, VA (US)

( * ) Notice: Subject to any disclaimer, the term of this patent is extended or adjusted under 35 U.S.C. 154(b) by 229 days.

(21) Appl. No.: 13/444,028

(22) Filed: Apr. 11, 2012

(65) Prior Publication Data

US 2013/0274036 A1 Oct. 17, 2013

(51) Int. Cl.
*A63B 59/02* (2006.01)
*A63B 65/12* (2006.01)

(52) U.S. Cl.
CPC ..... *A63B 59/02* (2013.01)
USPC ..... 473/513; D21/724

(58) Field of Classification Search
CPC ..... A63B 59/02
USPC ..... 473/505, 512, 513; D21/724
See application file for complete search history.

(56) References Cited

U.S. PATENT DOCUMENTS

| | | | | |
|---|---|---|---|---|
| 4,460,178 | A | 7/1984 | Ulman | |
| 7,238,128 | B1 * | 7/2007 | Filice et al. | 473/513 |
| 7,520,828 | B2 | 4/2009 | Tucker, Sr. et al. | |
| 2005/0075200 | A1 * | 4/2005 | Brine et al. | 473/513 |
| 2007/0151065 | A1 * | 7/2007 | Monahan et al. | 15/257.7 |
| 2013/0274036 | A1 * | 10/2013 | Spiegel | 473/513 |

* cited by examiner

*Primary Examiner* — Gene Kim
*Assistant Examiner* — M Chambers
(74) *Attorney, Agent, or Firm* — H. Jay Spiegel

(57) ABSTRACT

The inventive lacrosse stick has a head with a distal end which features a pivotable distal plate. The distal edge of the distal plate is recessed proximally of the distal end of the head so that movements of the plate do not in any way change the fixed length of the stick defined by portions of the head distal of the distal edge of the plate. The distal plate may be made in one of two ways. First, the plate may be made of a separate piece coupled to the lacrosse head and pivotable with respect thereto. In this embodiment, a spring is provided that acts to pivot the distal plate downwardly and to be restored to that orientation whenever it is pivoted upwardly. In a second embodiment, the plate is integrally molded with the head to include a living hinge pivoted upwardly.

20 Claims, 3 Drawing Sheets

LACROSSE STICK WITH IMPROVED BALL SCOOPING

BACKGROUND OF THE INVENTION

The present invention relates to a lacrosse stick with improved ball scooping. The game of lacrosse has existed for hundreds of years. The game of lacrosse was originally a game played by native Americans. As the game of lacrosse has evolved, it has become an extremely popular American college sport and is rapidly growing internationally in dozens of countries. Lacrosse has been played on an organized level in United States colleges since the late 1800s. Some college rivalries have lasted over 100 years.

The game of lacrosse is a game of possession. More often than not, the team that possesses the ball more than the other team will prevail. As the game of lacrosse is currently played, at the beginning of the game and after each score, there is a ritual known as a "face-off." In the face-off, two players have the ball placed between their lacrosse sticks and at the whistle a competition ensues for possession of the ball. In men's lacrosse, the ball is placed on the ground between the two lacrosse sticks. In women's lacrosse, the players are standing with their sticks aloft and the ball is placed between the sticks. During the face-off ritual, it is often the case that one of the two competing players does not, in fact, obtain possession of the ball. Rather, the ball is projected somewhere near or remote from the two competing players. When this occurs, other nearby players compete with one another for possession of the ball.

In looking at a sheet of statistics from a lacrosse game, often the most important statistic is described as "ground balls." What this statistic means is that when the ball is on the ground, a player from one or the other team is able to pick it up with their lacrosse stick and advance their team's play. The statistic counts the number of times a team has succeeded in picking up ground balls. Ground balls equal possessions. Thus, when a team is more successful in picking up ground balls, that team has more possessions than the other team and is often more likely to prevail.

The first lacrosse sticks were typically made out of wood and had a "crosse" which is the basket-like distal end of the stick that resembled the end of a giant spoon, not even having any netting installed. The preferred material for such sticks was hickory wood. Since the 1970s, the shaft of a lacrosse stick is typically made of a material such as plastic or lightweight metal or composite materials. Metals can include titanium and composite materials can include graphite. The head or "crosse" is attached to the distal end of the shaft and currently consists of a basket-like structure having a plastic molded periphery to which is strung a basket made of strands of nylon, leather, or other material. In lacrosse sticks currently made, the distal edge of the plastic molded periphery is typically arcuate with the most distal point being in the middle. In other words, the distal surface of the head of the lacrosse stick is essentially convex from the proximal perspective.

The National Collegiate Athletic Association (NCAA) has developed a set of rules governing the game of lacrosse including rules concerning the equipment to be employed. In those rules, Rule 1, sections 17 and 18 govern the dimensions of a lacrosse stick. One portion of those rules in section 17 requires the entire length of a lacrosse stick including the shaft and crosse to be of an "overall fixed length of either 40 to 42 inches (short crosse) or 52 to 72 inches (long crosse), except for the goal keeper's crosse, which shall be 40 to 72 inches long." The important words in this rule are "fixed length." Thus, the lacrosse stick is not permitted to have a length that is variable.

As explained above, in lacrosse sticks currently used, and typically in history, the distal edge of the head is arcuate and convex. The furthest edge is typically narrow in thickness to facilitate scooping up a lacrosse ball during play to achieve a "ground ball" pickup. However, these typical lacrosse sticks with their convex distal edges of the head are not actually optimized for that purpose. With their convex configuration, it is easily possible for the ball to slide laterally from its initial point of contact with the stick, thus causing the player to be unable to pick up the ball. A lacrosse stick head designed with more particularity concerning the concept of ground ball pickup would be advantageous.

U.S. Pat. No. 4,460,178 to Ulman discloses a friction and wear reducing system for lacrosse sticks which also shows the distal edge of the head with an arcuate shape designed to hug the ground and perhaps enhance ground ball pickup. However, the shape of the distal edge of the lacrosse head of Ulman is still convex leading to the same potential problems described above.

U.S. Pat. No. 7,520,828 to Tucker, Sr. et al. discloses a lacrosse head having a flexible stringing member and a recessed scoop. Tucker, Sr. et al. specifically show a lacrosse head in which the distal end includes a central portion that is concave, thereby more closely approximating the shape of the ball that is being scooped up by the head and therefore providing a better chance that the ball will be scooped up rather than deflected laterally. However, Tucker, Sr. et al. do not appreciate the fact that lacrosse players scoop up the ball in a variety of angular orientations of the lacrosse stick head with respect to the ground. In other words, the angulation of the distal edge of the lacrosse stick head is wildly variable from virtually parallel to the ground to sharply angled with respect thereto. This issue is not taken into account by Tucker, Sr. et al. or any other prior art known to Applicant.

As the game of lacrosse has become more and more competitive, a need has developed for a lacrosse stick that more effectively permits a player to scoop up a ground ball, gain his or her team another possession, and enhance the chances of victory. It is with these needs in mind that the present invention was developed.

SUMMARY OF THE INVENTION

The present invention relates to a lacrosse stick with improved ball scooping. The present invention includes the following interrelated objects, aspects and features:

(1) In a first aspect, the inventive lacrosse stick has its improvements concentrated in the head of the stick. The head includes a distal end which features a pivotable distal plate. The distal edge of the distal plate is recessed proximally of the distal end of the head so that movements of the plate do not in any way change the required fixed length of the stick which is defined by portions of the head distal of the distal edge of the plate.

(2) The distal plate may be made in one of two ways. First, the plate may be made of a separate piece coupled to the lacrosse head and pivotable with respect thereto. In this embodiment, preferably, a spring is provided that acts to pivot the distal plate downwardly and to be restored to that orientation whenever it is pivoted upwardly through engagement with a ground surface.

(3) A second embodiment of the pivotable distal plate is provided by integrally molding the plate when the head is molded. In this embodiment, the plate is molded in such a way that its default position is at the downward-most extent of pivoting and it includes a living hinge integrally molded therewith that restores it to the downward configuration whenever it is pivoted upwardly through engagement with a ground surface.

(4) The distal edge of the plate is preferably concavely arcuate, in other words, concave in the proximal direction of the stick, opposite to the typical convex arcuate nature of the distal end of a typical lacrosse stick. This configuration best facilitates scooping up a lacrosse ball.

(5) The downward default position of the pivotable distal plate is provided so that it provides an appropriate angle of attack of the distal edge of the plate regardless of the angular orientation of the lacrosse stick with respect to a ground surface. Thus, if the player is attempting to scoop up a ball with the proximal end of the stick significantly spaced from the ground so that the entire stick makes, for example, a 45° angle with the ground, the downward default position of the plate provides an appropriate angle of attack to facilitate scooping the ball up. Conversely, under circumstances in which the proximal end of the stick is closer to the ground so that the lacrosse stick makes a more shallow angle with respect to the ground, for example, less than 10°, the plate can pivot upwardly upon touching the ground to provide an appropriate angle of attack for best scooping of a lacrosse ball.

(6) In the preferred embodiments of the present invention, the head and the distal plate, whether formed integrally or separately, are made of a molded plastic material. Of course, other materials such as wood, composites like graphite, or other materials may suitably be used in making these components.

As such, it is a first object of the present invention to provide a lacrosse stick with improved ball scooping.

It is a further object of the present invention to facilitate enhanced ball scooping by providing a pivotable distal plate on the distal end of the head of the lacrosse stick for that purpose.

It is a yet further object of the present invention to provide such a device in which the distal edge of the distal plate is concavely arcuate in the direction of the proximal end of the stick to enhance scooping ability.

It is a still further object of the present invention to provide such a device in which the head and plate, whether formed integrally or separately, are made of a material such as plastic, wood, or composite materials such as, for example, graphite.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 8:
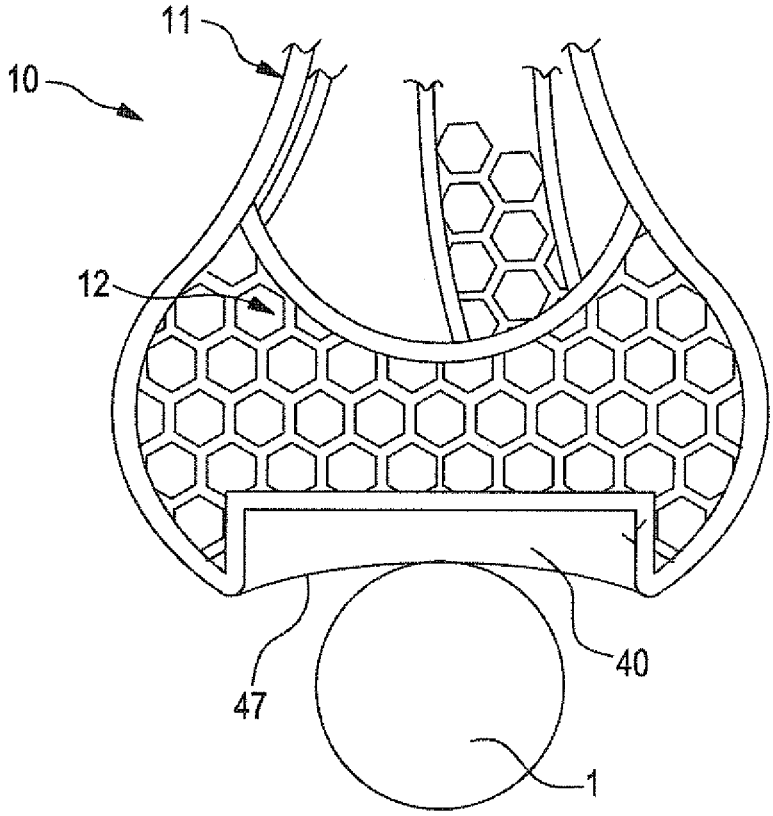
FIG. 8 shows a top view of the embodiment of FIGS. 1-5 showing the relationship between the concavely arcuate distal edge of the pivotable distal plate and a lacrosse ball.

Reference is first made to FIGS. 1-5 which show the present invention generally designated by the reference numeral 10. The inventive device is shown in connection with the head 11 of a lacrosse stick that typically includes netting 12 (FIG. 8). Of course, the netting is provided in compliance with the NCAA Rules for the game of lacrosse.

As shown in FIGS. 1-5, the head 11 includes a periphery including sides 13 and 15 which extend in the proximal-distal direction identified by the arrows P and D.

The periphery of the head 11 also includes the sides 13 and 15 terminating distally at the locations respectively identified by reference numerals 17 and 19. Proximal of the terminations 17 and 19, the periphery of the head 11 includes a C-shaped portion 21 made up of two distal to proximal legs 23 and 25 interconnected together by a lateral leg 27. These legs have respective inner surfaces 29, 31 and 33 that together define a generally rectangular recess.

Disposed within the rectangular recess is a plate 40 having peripheral surfaces 41, 43, 45 that closely match the surfaces 29, 33 and 31, respectively. The distal edge 47 of the plate is concavely arcuate as particularly shown in FIG. 1 and merges at its lateral edges with the terminations 17 and 19 of the sides 13 and 15 of the head 11. The top surface 42 of the plate 40 may be concave, with its center slightly lower than its lateral terminations, to enhance scooping ability.

Figure 2:
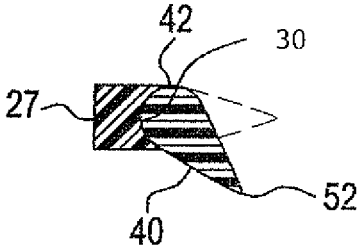
FIG. 2 shows a cross-sectional view along the line 2-2 of FIG. 1.

As seen in FIG. 2, the wall 27 has a proximally arcuate depression 30 receiving a proximally arcuate surface 42 of the plate 40. The interaction between the surfaces 30 and 42 permits smooth pivoting of the plate 40 with respect to the wall 27.

Figure 1:
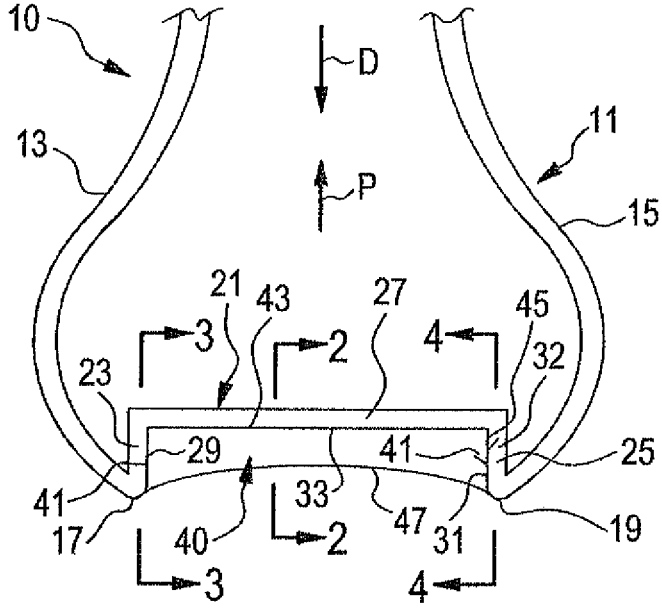
FIG. 1 shows a top view of a first embodiment of the present invention.
Figure 3:
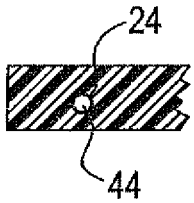
FIG. 3 shows a cross-sectional view along the line 3-3 of FIG. 1.
Figure 4:
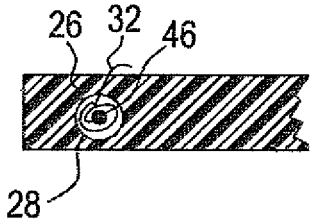
FIG. 4 shows a cross-sectional view along the line 4-4 of FIG. 1.

As shown in FIG. 3, the plate 40 has a pivot post or pin 44 received within a hole 24 extending into the wall 23 of the head 11. On the other side of the plate 40, a pivot post or pin 46 of the plate 40 is received within a larger hole 26 formed in the wall 25. The hole 26 is larger than the hole 24 because the hole 26 also receives the body of biasing means for biasing said plate in a downward orientation, comprising a spring 28. As seen in FIGS. 1 and 4, the spring 28 has end terminations 32 and 41. The end termination 32, also seen in FIG. 4, extends into engagement with the wall 25, whereas the end 41 extends into engagement with the plate 40. The spring 28 is configured to spring bias the plate 40 into the position shown in FIG. 2, angled downwardly with respect to the walls 23, 25 and 27 of the head 11.

As should be understood from the orientation of the plate 40 shown in FIG. 2, it may be pivoted in the counterclockwise direction in the view of FIG. 2 until it is coplanar with the wall 27 (see hatched lines in FIG. 2). In that position caused by engagement of the end 52 of the plate 40 with a ground surface, when that pressure is released, the plate 40 pivots back to the position and orientation shown in solid lines in FIG. 2, under the force of the spring 28.

Figure 5:
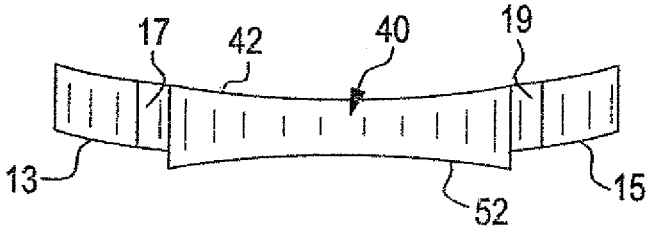
FIG. 5 shows a front view of the present invention.

FIG. 5 shows a front view of the plate 40 showing its distal terminating edge 52 below the terminations 17 and 19 of the walls 13 and 15. This should make clear with reference also to FIG. 2 that the plate 40 may enhance the ability of the user to scoop up a lacrosse ball regardless of the angle of attack of their stick.

Figure 6:
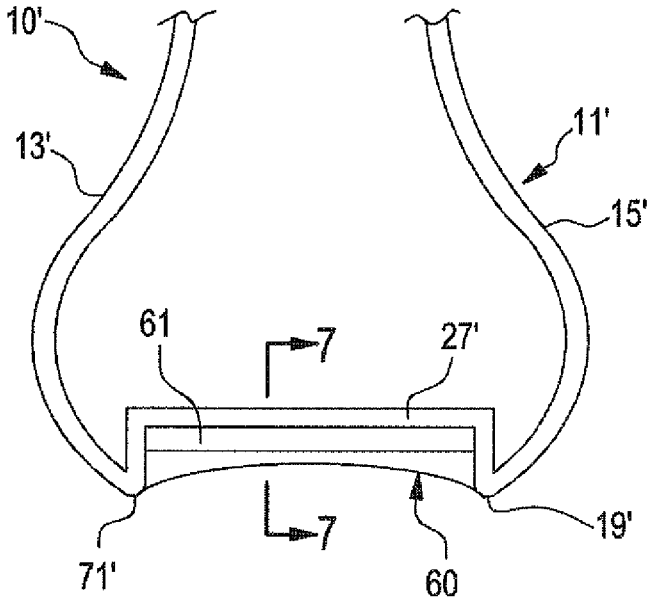
FIG. 6 shows a top view of a second embodiment of the present invention.
Figure 7:
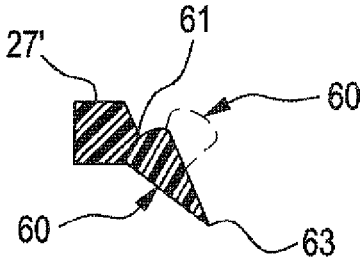
FIG. 7 shows a cross-sectional view along the line 7-7 of FIG. 6.

With reference to FIGS. 6 and 7, in which identical structures with respect to the embodiment of FIGS. 1-5 are referred to using like primed reference numerals, as shown, the plate 60 is instead integrally molded with the head 11. This is best seen with reference to FIG. 7. The position of the plate 60 in which it is coplanar with the wall 27' is shown in hatched lines in FIG. 7. Of note is the integrally molded recess 61 which provides a living hinge allowing the plate 60 to pivot in the counterclockwise direction in the view of FIG. 7 to a position in which it is coplanar with the wall 27' and, which occurs as a result of engagement of the distal termination 63 of the plate 60 with a ground surface. When pressure is relieved on the distal edge 63, the plate 60 pivots back to the position shown in solid lines in FIG. 7.

Figure 9:
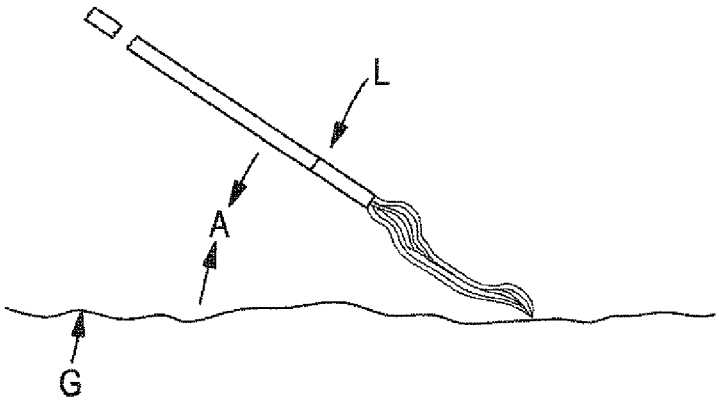
FIG. 9 shows a side view of the angular relationship between a lacrosse stick and a ground surface.

FIG. 8 shows the relationship between the distal edge 47 of the plate 40 and a lacrosse ball 1 engaging that edge. As should be understood, the arcuate nature of the edge 47 better facilitates capturing the ball 1 within the head of the stick 11 than is the case with prior art heads in which the distal termination of the head is convex in the distal direction. FIG. 9 shows the angle A between the lacrosse stick L and a ground surface G. The present invention is intended to enhance the ability of a lacrosse player to pick up ground balls regardless of the angle A.

As such, an invention has been disclosed in terms of preferred embodiments thereof which fulfill each and every one of the objects of the invention as set forth hereinabove and provide a new and useful lacrosse stick with improved ball scooping of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. In a lacrosse stick head having a proximal end and a distal end and a periphery partially defined by side walls terminating at terminations at said distal end, the improvement comprising a plate at said distal end of said head pivotably attached to said head at a pivot located just proximal of said distal end of said head and laterally inward of said terminations of said side walls, said plate being pivotable between first and second orientations with respect to said head and side walls, said plate having a distal edge engageable with a ground surface at any pivotable position of said plate to facilitate scooping up of a ball into a netting of said head.

2. The head of claim 1, wherein said distal edge is located proximal of said terminations of said side walls.

3. The head of claim 2, wherein said distal edge of said plate is concave in a distal to proximal direction.

4. The head of claim 2, wherein said plate has a downwardly dished top surface.

5. The head of claim 4, wherein said top surface is concave.

6. The head of claim 3, wherein said plate has a top surface that curves downwardly from its sides toward a center thereof.

7. The head of claim 1, wherein said plate is integrally formed with said head.

8. The head of claim 7, wherein said plate is connected to said head via an integrally formed hinge.

9. The head of claim 8, wherein said head and hinge are made of molded plastic.

10. The head of claim 1, wherein said plate is attached to said head at two opposed pivots.

11. The head of claim 10, wherein said pivots comprise pins.

12. The head of claim 10, further including biasing means for biasing said plate in a direction at which said distal edge is below said distal terminations of said side walls.

13. The head of claim 12, wherein said biasing means comprises a spring.

14. The head of claim 11, wherein said head includes a C-shaped wall that pivotably receives said plate.

15. The head of claim 1, wherein said plate has a distal concave edge.

16. The head of claim 15, wherein said plate has a downwardly dished top surface.

17. In a plastic lacrosse stick head having a proximal end and a distal end and a periphery partially defined by side walls terminating at terminations at said distal end, the improvement comprising a plate at said distal end of said head pivotably attached to said head at a pivot located just proximal of said distal end of said head and laterally inward of said terminations of said side walls, said plate being pivotable between first and second orientations with respect to said head and side walls, said plate having a distal concave edge located proximal of said distal terminations of said side walls, said plate having a top surface that curves downwardly from its sides toward a center thereof.

18. The head of claim 17, wherein said plate is integrally formed with said head and connected to said head via an integrally formed hinge.

19. The head of claim 17, wherein said plate is attached to said head at two opposed pivot pins.

20. The head of claim 19, further including biasing means for biasing said plate in a direction at which said distal edge is below said terminations of said side walls, said biasing means comprising a spring.

* * * * *